US007159565B2

(12) United States Patent
Demura et al.

(10) Patent No.: US 7,159,565 B2
(45) Date of Patent: Jan. 9, 2007

(54) METHOD OF CONTROLLING IGNITION TIMING IN INTERNAL COMBUSTION ENGINE

(75) Inventors: Takayuki Demura, Mishima (JP); Tetsuji Nagata, Kariya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/189,759

(22) Filed: Jul. 27, 2005

(65) Prior Publication Data

US 2006/0021597 A1 Feb. 2, 2006

(30) Foreign Application Priority Data

Jul. 30, 2004 (JP) ..... 2004-224717

(51) Int. Cl.
*F02P 5/00* (2006.01)
*F02P 5/04* (2006.01)

(52) U.S. Cl. ..... 123/406.47; 123/406.31; 123/406.3

(58) Field of Classification Search ..... 123/406.21, 123/406.35, 406.45, 406.47, 406.29, 431, 123/299, 300
See application file for complete search history.

(56) References Cited

U.S. PATENT DOCUMENTS 4,727,841 A * 3/1988 Hirose et al. ..... 123/406.34
4,729,358 A * 3/1988 Morita et al. ..... 123/406.47
5,483,935 A * 1/1996 Ogawa et al. ..... 123/406.47
5,529,040 A * 6/1996 Takeda et al. ..... 123/406.35
6,041,755 A * 3/2000 Mashiki ..... 123/406.29
6,089,206 A * 7/2000 Suzuki et al. ..... 123/295
6,915,784 B1 * 7/2005 Tomoda et al. ..... 123/431
2006/0037581 A1 * 2/2006 Miyashita et al. ..... 123/305

FOREIGN PATENT DOCUMENTS

| | | |
|---|---|---|
| EP | 0 826 880 A2 | 3/1998 |
| EP | 0 943 793 A2 | 9/1999 |
| EP | 1 277 942 A2 | 1/2003 |
| EP | 1 561 936 A2 | 8/2005 |
| JP | A 05-231221 | 9/1993 |
| JP | A 11-303669 | 11/1999 |
| JP | A 2001-020837 | 1/2001 |

* cited by examiner

*Primary Examiner*—Mahmoud Gimie
(74) *Attorney, Agent, or Firm*—Oliff & Berridge, PLC

(57) ABSTRACT

An internal combustion engine includes an in-cylinder injector injecting a fuel into a cylinder and an intake port injector injecting a fuel into an intake port. In the internal combustion engine, when a fuel injection ratio between the in-cylinder injector and the intake port injector is changed such that the ratio of fuel injection from the in-cylinder injector is increased, ignition timing is retard-corrected for a prescribed period after that change.

2 Claims, 6 Drawing Sheets

METHOD OF CONTROLLING IGNITION TIMING IN INTERNAL COMBUSTION ENGINE

This nonprovisional application is based on Japanese Patent Application No. 2004-224717 filed with the Japan Patent Office on Jul. 30, 2004, the entire contents of which are hereby incorporated by reference.

BACKGROUND OF THE INVENTION

1. Field of the Invention

The present invention relates to a method of controlling ignition timing in an internal combustion engine, and more particularly to a method of controlling ignition timing in what is called a dual-injection-type internal combustion engine including an in-cylinder injector injecting a fuel into a cylinder and an intake port injector injecting a fuel into an intake manifold or an intake port.

2. Description of the Background Art

In general, what is called a dual-injection-type internal combustion engine including an in-cylinder injector injecting a fuel into a cylinder and an intake port injector injecting a fuel into an intake manifold or an intake port is known (for example, Japanese Patent Laying-Open Nos. 2001-020837, 05-231221, and the like), in which use of these injectors is switched in accordance with an operation state of the engine so as to realize stratified charge combustion in a low-load operation region and homogeneous combustion in a high-load operation region and so as to inject the fuel at a prescribed injection ratio in accordance with the operation state, for achieving improvement in fuel efficiency characteristic and output characteristic.

Generally in a fuel-injection-type internal combustion engine, in order to achieve appropriate combustion in accordance with the operation state, various corrective advance (or corrective retard) values in accordance with the state of the engine are added to a basic ignition timing value that has been set in advance in correspondence with the operation state and stored in a map or the like, so as to calculate final ignition timing. Based on that ignition timing, ignition is carried out and the engine is operated.

In the dual-injection-type internal combustion engine described above, there is a difference in a temperature in a combustion chamber due to a difference in the injection manner, between an injection manner where the fuel is injected from the in-cylinder injector and an injection manner where the fuel is injected from the intake port injector. Specifically, in the in-cylinder injection where the fuel is injected from the in-cylinder injector, as compared with port injection, the temperature in the combustion chamber is lowered as a result of a cooling effect of latent heat of vaporization of the fuel injected into the cylinder. Therefore, in a normal operation state in in-cylinder injection, an appropriate basic ignition timing value adapted to such a combustion chamber temperature is determined.

Meanwhile, in a transition operation such as switching of the injection manner from the intake port injector to the in-cylinder injector or change in an injection ratio, the cooling effect described above is not exhibited immediately and the combustion chamber temperature is higher than in the normal operation state, in which case knocking is likely.

SUMMARY OF THE INVENTION

An object of the present invention is to provide a method of controlling ignition timing in an internal combustion engine including an intake port injector and an in-cylinder injector, capable of achieving suppression of occurrence of knocking when switching of an injection manner from port injection to in-cylinder injection is made or an injection ratio is changed.

In order to achieve the object above, a method of controlling ignition timing in an internal combustion engine including an in-cylinder injector and an intake port injector according to the present invention is characterized in that, when a ratio of fuel injection from the in-cylinder injector and the intake port injector is changed such that the ratio of fuel injection from the in-cylinder injector is increased, ignition timing is retard-corrected for a prescribed period after that change.

Here, the prescribed period is preferably set to a period until a temperature in a combustion chamber becomes stable.

It is noted that, in the present specification, unless otherwise specified, "change in the fuel injection ratio" encompasses change between injection only from the in-cylinder injector (that is, in-cylinder injection ratio 100%) and injection only from the intake port injector (that is, in-cylinder injection ratio 0%), i.e., switching of injection between in-cylinder injection 100% and port injection 100%, as well as change in the ratio of fuel injection from these injectors when both of these injectors simultaneously inject the fuel at a prescribed injection ratio.

According to the method of controlling ignition timing in an internal combustion engine including an in-cylinder injector and an intake port injector of the present invention, the ratio of fuel injection from the in-cylinder injector and the intake port injector is changed such that the ratio of fuel injection from the in-cylinder injector is increased, the ignition timing is retard-corrected for a prescribed period after the change, whereby abnormal combustion such as occurrence of knocking can be suppressed.

In particular, if the prescribed period is set to a period until the combustion chamber temperature becomes stable, the ignition timing is retard-corrected for the prescribed period after the change until the combustion chamber temperature becomes stable. Therefore, abnormal combustion such as occurrence of knocking can more reliably be suppressed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment implementing a method of controlling ignition timing in an internal combustion engine according to the present invention will be described hereinafter with reference to the accompanying drawings.

Figure 1:
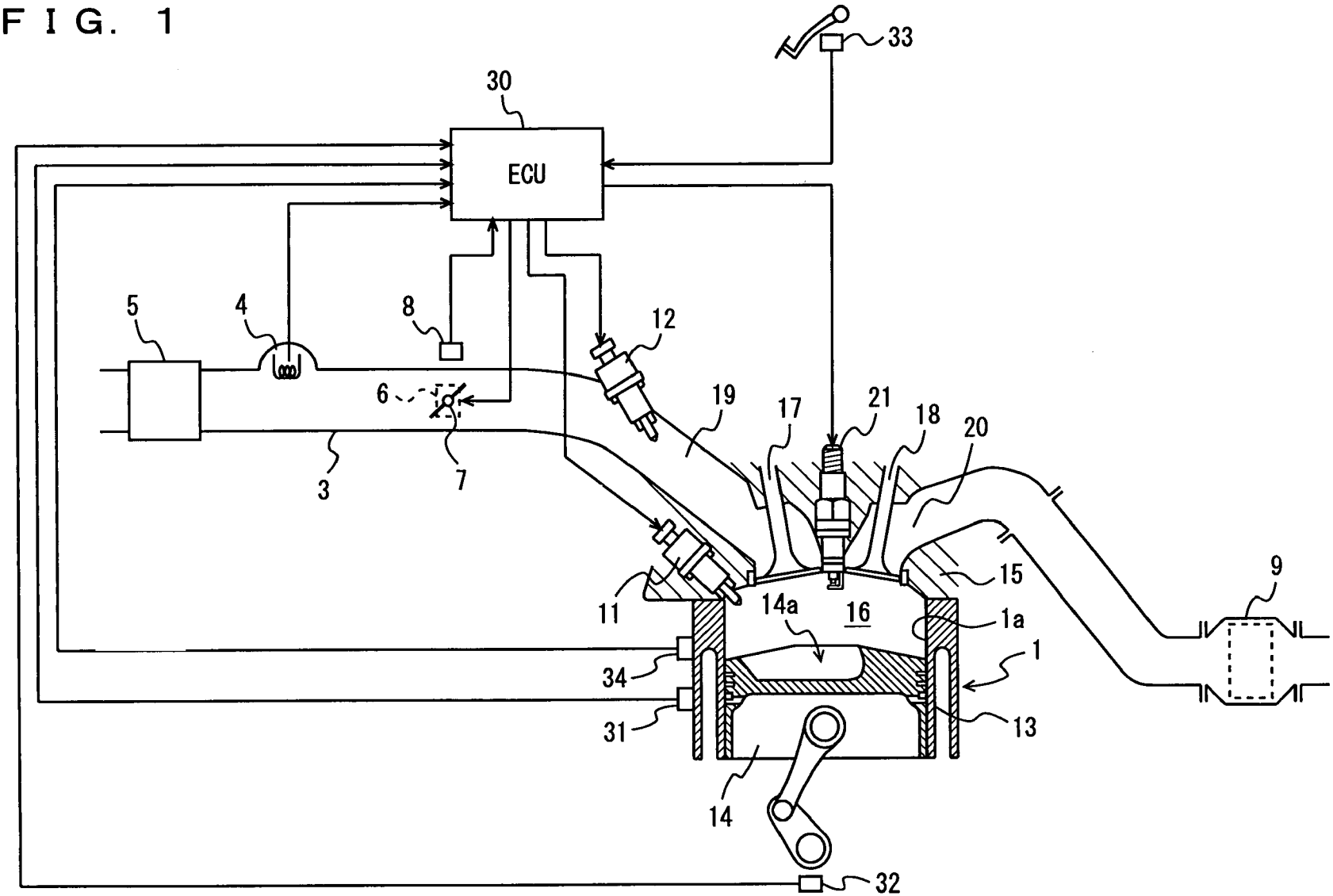
FIG. 1 is a schematic diagram showing an overall structure of an internal combustion engine in which a method of controlling ignition timing according to the present invention is performed.

Initially, referring to FIG. 1 showing an overall structure of the internal combustion engine in which the method of controlling ignition timing according to the present invention is employed, an engine 1 is implemented as a gasoline engine including a plurality of (for example, four) cylinders 1*a*. Each cylinder 1*a* is connected to an intake pipe 3 via a corresponding intake manifold, and intake pipe 3 is connected to an air cleaner 5 with an airflow meter 4 being interposed. In intake pipe 3, a throttle valve 7 driven by a throttle motor 6 such as a direct-current motor is disposed. Meanwhile, each cylinder 1*a* is coupled to a common exhaust manifold, which is coupled, for example, to a three-way catalyst converter 9.

An in-cylinder injector 11 for injecting the fuel into the cylinder and an intake port injector 12 for injecting the fuel into an intake manifold or an intake port are attached to each cylinder 1*a*. As will be described later, injectors 11 and 12 are controlled based on output signals from an electronic control unit 30. In addition, each in-cylinder injector 11 is connected to a not-shown common fuel delivery pipe, which is connected to a high-pressure pump. Meanwhile, each intake port injector 12 is similarly connected to a not-shown common fuel delivery pipe, which is connected to a low-pressure pump.

Moreover, cylinder l*a*includes a cylinder block 13, a piston 14 having a concave portion 14*a* formed in its top surface, a cylinder head 15 fastened to cylinder block 13, a combustion chamber 16 formed between piston 14 and cylinder head 15, an intake valve 17, an exhaust valve 18, an intake port 19, an exhaust port 20, and a spark plug 21 turned on by a not-shown igniter. Intake port 19 is formed such that air that has flown into combustion chamber 16 causes swirl around a cylinder axis. Concave portion 14*a* on the top surface of piston 14 is formed such that it extends from a peripheral portion to a central portion of piston 14 positioned on in-cylinder injector 11 side and extends toward spark plug 21.

Electronic control unit (hereinafter, also referred to as ECU) 30 is implemented by a digital computer, and includes an ROM (read-only memory), an RAM (random access memory), a CPU (microprocessor), an input/output port, and the like connected to one another via a bidirectional bus. Airflow meter 4 generates an output voltage proportional to an intake air quantity, which is input to an input port of ECU 30 through an AD converter. In addition, a throttle opening position sensor 8 generating an output voltage proportional to an opening position of throttle valve 7, a water temperature sensor 31 generating an output voltage proportional to a cooling water temperature, an engine speed sensor 32 generating an output pulse representing the engine speed, an accelerator press-down degree sensor 33 generating an output voltage proportional to a degree of pressing down of an accelerator pedal (hereinafter, referred to as accelerator press-down degree), a knock sensor 34 arranged in cylinder block 13 and generating an output voltage proportional to vibration transmitted from combustion chamber 16 to cylinder block 13 in each cylinder, and the like are provided. Output voltages from these components are similarly input to ECU 30.

The fuel injection ratio and a fuel injection quantity, set in correspondence with the operation state based on an engine load factor obtained from airflow meter 4 or accelerator press-down degree sensor 33 described above and the engine speed obtained from engine speed sensor 32, as well as a correction value for the former based on a temperature of the engine cooling water are mapped in advance and stored in the ROM in ECU 30. As to the ignition timing and the throttle opening position, optimal values for the ignition timing and the throttle opening position that have been set in correspondence with the operation region based on the accelerator press-down degree and the engine speed obtained from accelerator press-down degree sensor 33 and engine speed sensor 32 are mapped in advance and stored. In addition, an output port of ECU 30 is connected to throttle motor 6, each in-cylinder injector 11, each intake port injector 12, and the igniter of spark plug 21 via a corresponding drive circuit. ECU 30 controls the engine in a variety of manners, such as fuel injection control or ignition timing control, in accordance with the operation state of engine 1 known from a detection signal of such various sensors.

Figure 2:
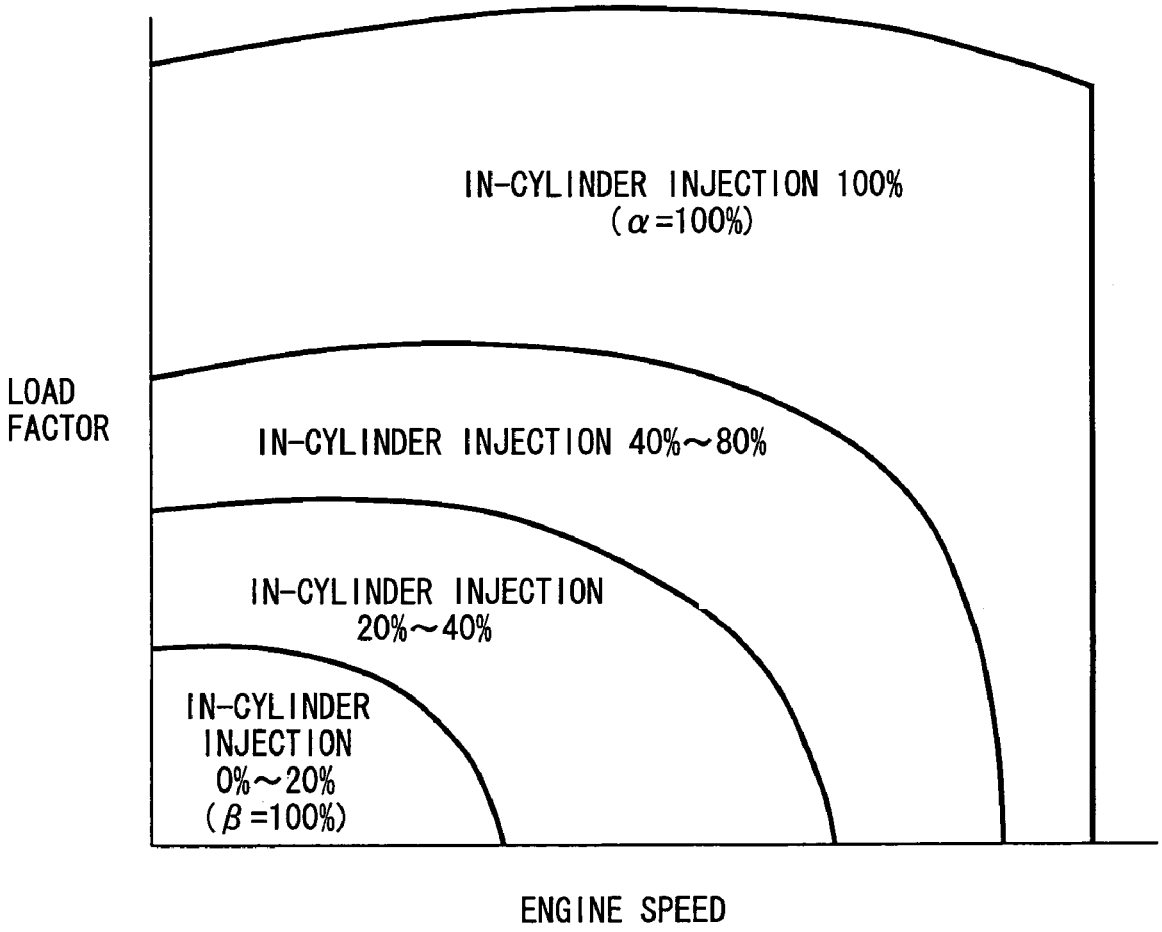
FIG. 2 is a graph showing exemplary relation between an operation state of the internal combustion engine and a fuel injection ratio at that time.

In engine 1 of the present embodiment, for example, a combustion manner or an injection manner is set in correspondence with the operation region or a condition map as shown in FIG. 2, and ratio $\alpha$ and ratio $\beta$ of injection from in-cylinder injector 11 and intake port injector 12 respectively are determined. Here, in-cylinder injection ratio a represents a ratio of a quantity of fuel injected from in-cylinder injector 11 to the total fuel injection quantity, while port injection ratio $\beta$ represents a ratio of a quantity of fuel injected from intake port injector 12 to the total fuel injection quantity. Here, $\alpha+\beta=100\%$. In FIG. 2, in-cylinder injection 100% represents a region where ratio $\alpha$ of injection only from in-cylinder injector 11 is set to 100%, that is, $\beta=0\%$. Meanwhile, in-cylinder injection 0% represents a region where ratio $\beta$ of injection only from intake port injector 12 is set to 100%, that is, $\alpha=0\%$. Furthermore, in-cylinder injection 40–80% means that $\alpha$ is set to 40–80% and $\beta$ is set to 60–20%, however, values for ratio $\alpha$ and ratio $\beta$ may be varied as appropriate, in accordance with the operation condition required to engine 1 that is used.

As described above, in engine 1 of the present embodiment, the injection manner is changed in accordance with the engine operation state, so as to ensure homogeneity of an air-fuel mixture and to improve output of engine 1 in the high-load region. Specifically, use of intake port injector 12 tends to promote homogeneity of the air-fuel mixture, as compared with the use of in-cylinder injector 11. Accordingly, in the operation region from low load to intermediate load, in-cylinder injector 11 and intake port injector 12 are used to attain a different fuel injection ratio therebetween so as to ensure homogeneity of the air-fuel mixture and to improve combustion. Meanwhile, when in-cylinder injector 11 is used for fuel injection, due to the latent heat of vaporization, lowering in the temperature of the air-fuel mixture and in the temperature in the combustion chamber is more likely than when intake port injector 12 is used for fuel injection. Therefore, in-cylinder injector 11 is used in the high-load operation region, so that efficiency in charging the air is enhanced and engine output is improved.

Initially, ignition timing control in engine 1 according to the present embodiment will be described. ECU 30 carries out knocking determination for determining whether or not knocking has occurred in each cylinder, based on a result of detection by knock sensor 34 described above, and in accordance with the result, ECU 30 exerts knock control for adjusting the ignition timing, warm-up characteristic control for appropriate advance or retard in accordance with the temperature of the cooling water, or adjustment and control during transition.

Under the knock control, if it is determined in knocking determination that knocking has occurred, the final ignition timing is retarded by a prescribed amount. If it is determined that no knocking has occurred, the final ignition timing is gradually advanced. The final ignition timing is expressed by a crank angle (BTDC) relative to the top dead center of each cylinder, and basically calculated as shown in the equation below.

Final Ignition Timing=Basic Ignition Timing±Various Correction Amounts

It is noted that the basic ignition timing represents ignition timing at which maximum engine output can be obtained, determined for each injection manner such as port injection, in-cylinder injection and both of the former on the premise that the engine is in the normal operation state where knocking or the like does not occur. The basic ignition timing is set as a two-dimensional map based on the engine operation state represented by a parameter such as the engine speed and the engine load factor. ECU 30 outputs to the igniter of spark plug 21 of each cylinder, an ignition signal which is turned on at timing indicated by the final ignition timing calculated in the above-described manner, whereby ignition is carried out.

In the present specification, change in the fuel injection ratio encompasses change in the injection manner, that is, switching between in-cylinder injection and port injection, as well as change in the ratio of fuel injection from these injectors. As to the fuel injection ratio, in-cylinder injection ratio $\alpha$+port injection ratio $\beta$=100%, and $\beta=100-\alpha$ as described above. Therefore, in the following, description will be given by using only in-cylinder injection ratio $\alpha$ representing the ratio of fuel injection from in-cylinder injector 11.

(First Embodiment)

Figure 3:
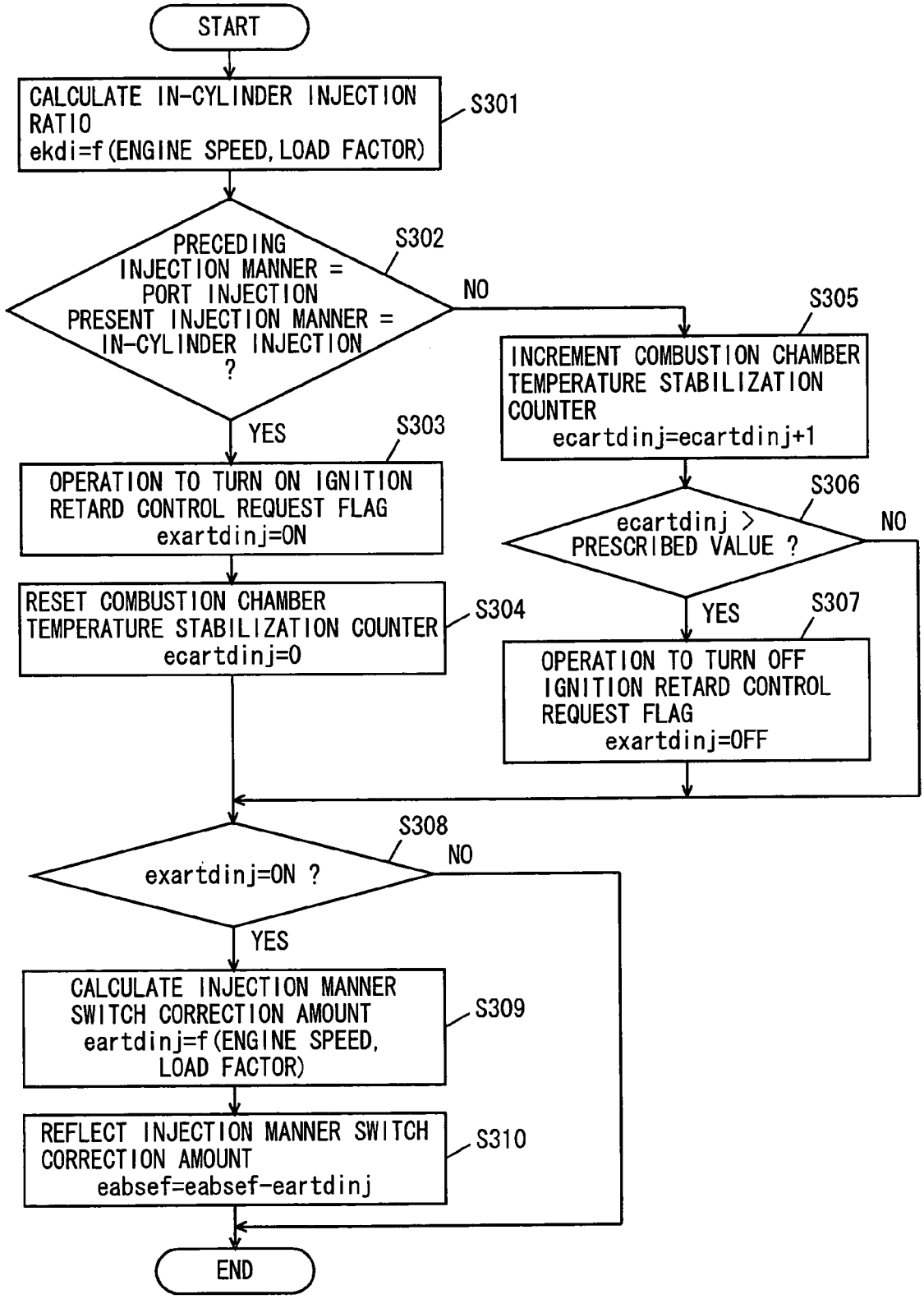
FIG. 3 is a flowchart showing a first embodiment of a processing procedure in the method of controlling ignition timing according to the present invention.

Referring to the flowchart in FIG. 3, an ignition timing control procedure of a first embodiment of the method of controlling ignition timing in the internal combustion engine according to the present invention will initially be described. This routine is executed, for example, each time a crank angle advances by a prescribed angle.

First, when control is started, in-cylinder injection ratio $\alpha$ to total fuel injection is calculated at step S301. More specifically, in-cylinder injection ratio $\alpha$ corresponding to the current operation state (denoted as "ekdi" in FIG. 3) is calculated from a map or by operation, based on the engine load factor obtained from airflow meter 4 or accelerator press-down degree sensor 33 and on the engine speed representing a calculation value from engine speed sensor 32, serving as various parameters representing the operation state.

At next step S302, whether or not switching between the injectors has been made is determined based on in-cylinder injection ratio $\alpha$. Specifically, whether or not change from injection solely from intake port injector 12 (that is, in-cylinder injection ratio $\alpha$=0%) to injection solely from in-cylinder injector 11 (that is, in-cylinder injection ratio $\alpha$=100%) has been made, that is, whether or not switching from port injection to in-cylinder injection has been made, is determined based on whether or not a preceding injection manner has been port injection and whether or not a present injection manner is in-cylinder injection.

In the first routine cycle after the injection manner is changed, that is, after switching from port injection to in-cylinder injection is made, the process proceeds to step S303, where an ignition retard control request flag "exartdinj" is set to on. At next step S304, a count value "ecartdinj" of a combustion chamber temperature stabilization counter is reset to 0.

If it is determined at step S302 described above that the injection manner has not been changed, the process proceeds to step S305, where count value "ecartdinj" of the combustion chamber temperature stabilization counter is incremented by 1. At next step S306, whether or not count value "ecartdinj" has exceeded a prescribed value is determined. The prescribed value is set, for example, to approximately 10 times of ignition for each one cylinder. If count value "ecartdinj" has not exceeded the prescribed value, the process proceeds to step S308 which will be described later. Therefore, for a prescribed period immediately after the change of the injection manner (determined by the prescribed value described above), ignition retard control request flag "exartdinj" set to on at step S303 is maintained at the on state, and ignition retard control which will be described later is carried out.

If it is determined at step S306 that count value "ecartdinj" has exceeded the prescribed value, the process proceeds to step S307. Here, ignition retard control request flag "exartdinj" is set to off, and the routine ends as will be described later.

After step S304 described above, or if it is determined at step S306 described above that count value "ecartdinj" has not exceeded the prescribed value, or after step S307, the process proceeds to step S308, and whether ignition retard control request flag "exartdinj" is set to on or off is determined. If ignition retard control request flag "exartdinj" is on, the process proceeds to step S309, where an injection manner switch correction amount "eartdinj" is calculated. Injection manner switch correction amount "eartdinj" is calculated from a map obtained in advance as a result of an experiment or the like and stored in a memory as a value corresponding to the operation state after switching or change of the injection manner, based on the engine load factor obtained from accelerator press-down degree sensor 33 and on the engine speed representing a calculation value from engine speed sensor 32, serving as various parameters representing the operation state. At next step S310, injection manner switch correction amount "eartdinj" is reflected on the basic ignition timing value. That is, a new ignition timing value "eabsef" obtained by subtracting injection manner switch correction amount "eartdinj" from basic ignition timing value "eabsef" is set, the basic ignition timing value being set in advance in correspondence with the normal operation state in the in-cylinder injection manner after switching between the injection manners and stored in a map or the like. In this manner, ignition is carried out and the engine is operated, using new ignition timing value "eabsef" set in accordance with the ignition timing control procedure described above.

Figure 4:
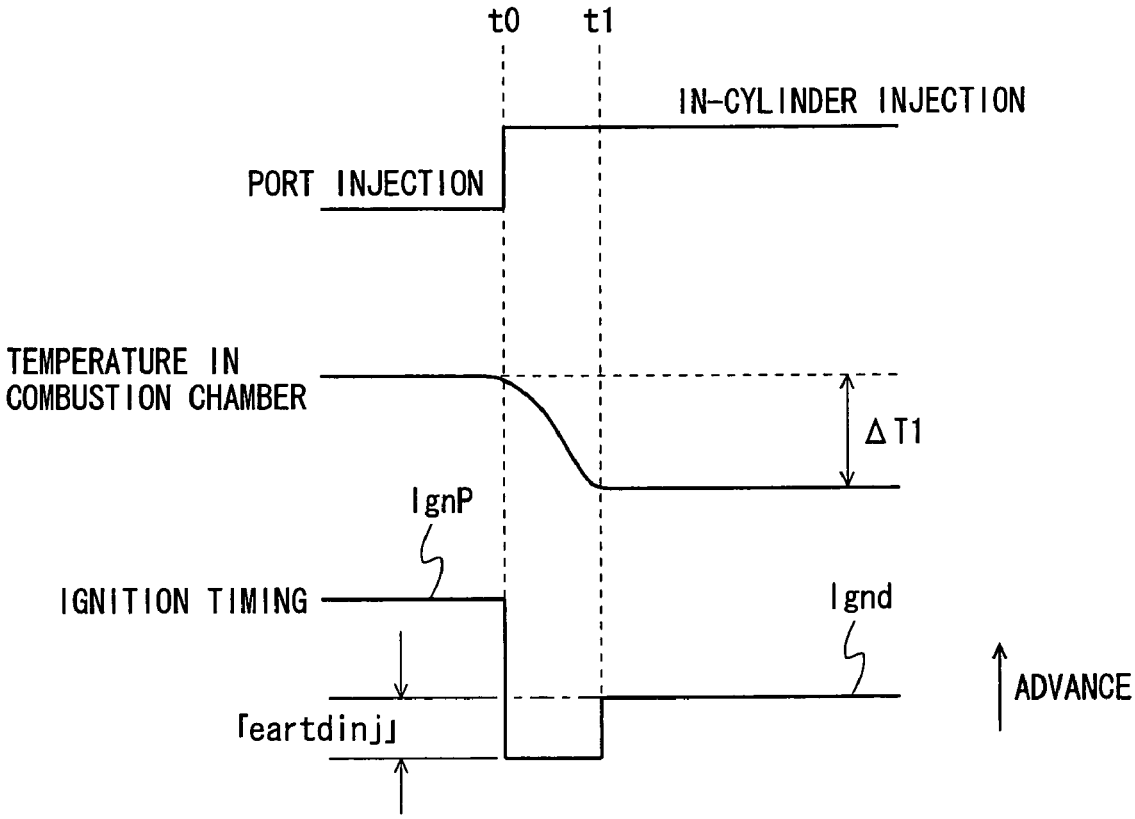
FIG. 4 is a time chart showing a manner of retard control of the ignition timing.

Here, referring to the time chart in FIG. 4, a manner how ignition retard control is exerted for the prescribed period after switching between the injection manners described above will further be discussed. FIG. 4 shows exemplary injection manner switching from port injection to in-cylinder injection made at time t0.

As can clearly be seen from FIG. 4, when switching from port injection to in-cylinder injection is made at time t0, the temperature in the combustion chamber starts to lower, and after a prescribed period (t0 to t1) has passed, the temperature becomes stable at a temperature corresponding to in-cylinder injection. Here, a temperature difference is denoted as ΔT1. As to the ignition timing, the ignition timing is set to "Ignp" during port injection. When switching to in-cylinder injection is made, requested ignition timing is set to "Ignd" (corresponding to basic ignition timing value "eabsef" described above). In the present embodiment, however, the ignition timing is set to the ignition timing retarded from requested ignition timing "Ignd" by injection manner switch correction amount "eartdinj" described above for the prescribed period (t0 to t1) until the temperature in the combustion chamber becomes stable. Therefore, as the ignition timing is retard-corrected for the prescribed period (t0 to t1) after switching until the temperature in the combustion chamber becomes stable, abnormal combustion such as occurrence of knocking can be suppressed.

(Second Embodiment)

Figure 5:
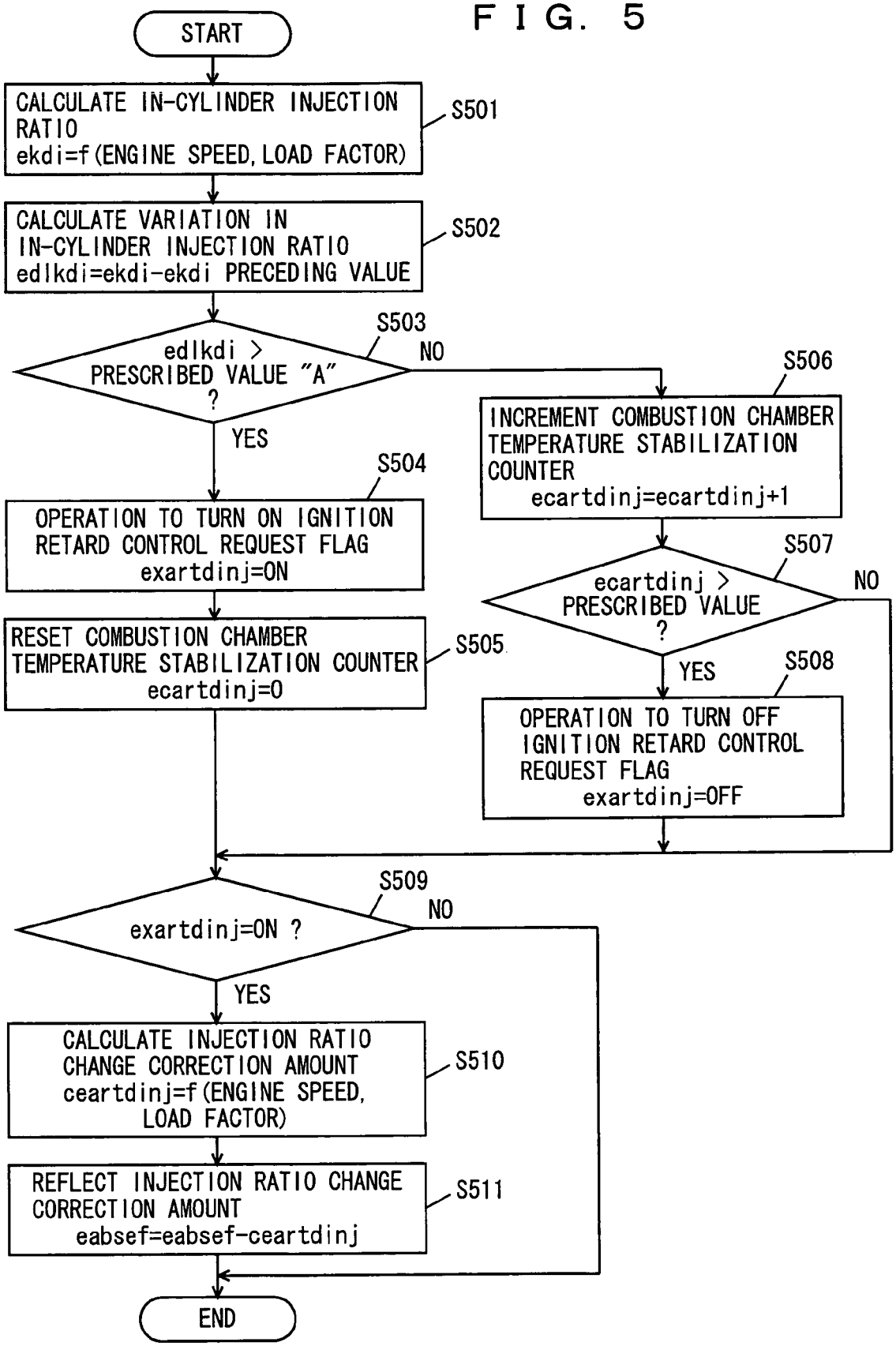
FIG. 5 is a flowchart showing a second embodiment of a processing procedure in the method of controlling ignition timing according to the present invention.

Referring to the flowchart in FIG. 5, an ignition timing control procedure of a second embodiment of the method of controlling ignition timing in the internal combustion engine according to the present invention will be described. This routine is executed also each time a crank angle advances by a prescribed angle. The second embodiment is different from the first embodiment described above in that, in the first embodiment, the ignition timing retard control has been based on change in the injection manner, that is, switching from port injection to in-cylinder injection, whereas in the second embodiment, it is based on change in the fuel injection ratio and on whether or not a difference between before and after the change exceeds a prescribed value.

In the second embodiment, when control is started, the in-cylinder injection ratio to total fuel injection (denoted as "ekdi" in FIG. 5) is calculated at step S501 in a manner similar to the first embodiment, from a map or by operation, based on the engine load factor and the engine speed serving as parameters representing the operation state. At next step 502, in-cylinder injection ratio variation "edlkdi" is calculated. This is calculated as a difference between in-cylinder injection ratio "ekdi" calculated at step S501 and the preceding in-cylinder injection ratio. At next step S503, whether or not calculated variation "edlkdi" exceeds a prescribed value "A" is determined. Specifically, whether or not significant change in the in-cylinder injection ratio by more than prescribed value "A" (for example, 50%) has been made is determined.

If variation "edlkdi" has exceeded prescribed value "A", the process proceeds to step S504, and ignition retard control request flag "exartdinj" is set to on. At next step S505, count value "ecartdinj" of the combustion chamber temperature stabilization counter is reset to 0.

If it is determined at step S503 described above that variation "edlkdi" has not exceeded the prescribed value in a first or next routine cycle, the process proceeds to step S506, where count value "ecartdinj" of the combustion chamber temperature stabilization counter is incremented by 1. At next step S507, whether or not count value "ecartdinj" has exceeded a prescribed value is determined. The prescribed value is set, for example, to approximately 10 times of ignition for each one cylinder, as in the previous embodiment. If count value "ecartdinj" has not exceeded the prescribed value, the process proceeds to step S509 which will be described later. Therefore, for a prescribed period immediately after the change in the fuel injection ratio (determined by the prescribed value described above), ignition retard control request flag "exartdinj" set to on at step S504 is maintained at the on state, and ignition retard control which will be described later is carried out.

If it is determined at step S507 that count value "ecartdinj" has exceeded the prescribed value, the process proceeds to step S508. Ignition retard control request flag "exartdinj" is set to off, and the routine ends as will be described later.

After step S505, or if it is determined at step S507 that count value "ecartdinj" has not exceeded the prescribed value, or after step S508, the process proceeds to step S509, and whether ignition retard control request flag "exartdinj" is set to on or off is determined. If ignition retard control request flag "exartdinj" is on, the process proceeds to step S510, where an injection ratio change correction amount "ceartdinj" is calculated. Injection ratio change correction amount "ceartdinj" is calculated from a map obtained in advance as a result of an experiment or the like and stored in a memory as a value corresponding to the operation state after the change in the in-cylinder injection ratio, based on the engine load factor obtained from accelerator press-down degree sensor 33 and on the engine speed representing a calculation value from engine speed sensor 32 serving as various parameters representing the operation state. At next step S511, injection ratio change correction amount "ceartdinj" is reflected on the basic ignition timing value. That is, a new ignition timing value "eabsef" obtained by subtracting injection ratio change correction amount "ceartdinj" from basic ignition timing value "eabsef" is set, the basic ignition timing value being set in advance in correspondence with the normal operation state in the in-cylinder injection manner after the change in the injection ratio and stored in a map or the like. In this manner, ignition is carried out and the engine is operated, by using new ignition timing value "eabsef" set in accordance with the ignition timing control procedure described above.

Figure 6:
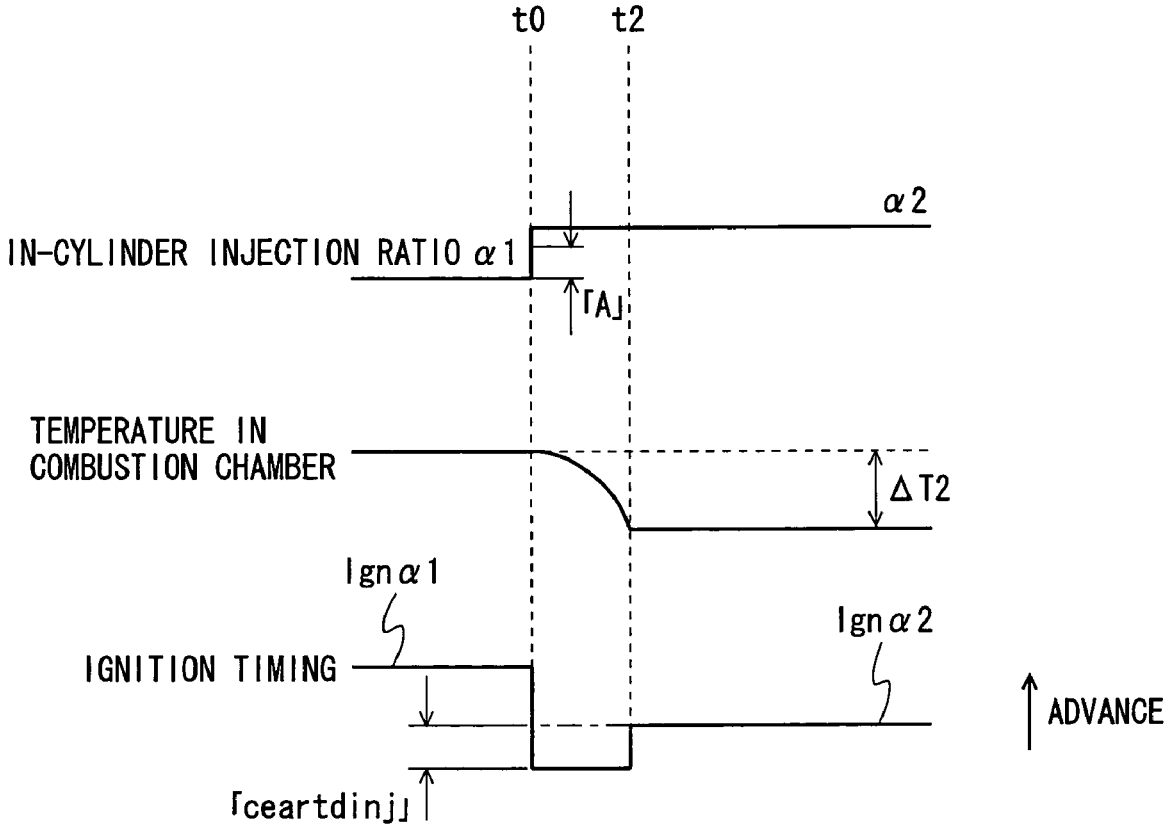
FIG. 6 is a time chart showing a manner of retard control of the ignition timing.

Here, referring to the time chart in FIG. 6, a manner how ignition retard control is exerted for the prescribed period after the change in the injection ratio described above will be discussed. FIG. 6 shows exemplary injection ratio change from in-cylinder injection ratio $\alpha 1$ to $\alpha 2$ at time t0 ($\alpha 2 > \alpha 1$, $\alpha 2 - \alpha 1 > A$).

As can clearly be seen from FIG. 6, when the in-cylinder injection ratio is changed to larger injection ratio $\alpha 2$ at time t0, the ratio of the fuel directly injected into the combustion chamber is also increased and the temperature in the combustion chamber starts to lower. After a prescribed period (t0 to t2) has passed, the temperature becomes stable at a temperature corresponding to the in-cylinder injection ratio. Here, a temperature difference is denoted as ΔT2. As to the ignition timing, the ignition timing is set to "Ignα1" when the in-cylinder injection ratio is set to $\alpha 1$. When the in-cylinder injection ratio is changed to $\alpha 2$, requested ignition timing is set to "Ignα2" (corresponding to basic ignition timing value "eabsef" described above). In the present embodiment, however, the ignition timing is set to the ignition timing retarded from requested ignition timing "Ignα2" by injection ratio change correction amount "ceartdinj" described above for the prescribed period (t0 to t2) until the temperature in the combustion chamber becomes stable. Therefore, as the ignition timing is retard-corrected for the prescribed period (t0 to t2) after the change until the temperature in the combustion chamber becomes stable, abnormal combustion such as occurrence of knocking can be suppressed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of controlling spark ignition timing in an internal combustion engine including an in-cylinder injector and an intake port injector; the method comprising:

retard-correcting ignition timing for a prescribed period after a ratio of fuel injection of said in-cylinder injector to said intake port injector is changed such that an amount of fuel injection from said in-cylinder injector is increased.

2. The method of controlling spark ignition timing in an internal combustion engine according to claim 1, wherein said prescribed period is set to a period until a temperature in a combustion chamber becomes stable.

* * * * *